United States Patent [19]

Campau

[11] 4,398,965

[45] Aug. 16, 1983

[54] METHOD OF MAKING IRON GOLF CLUBS WITH FLEXIBLE IMPACT SURFACE

[75] Inventor: Daniel N. Campau, Grand Rapids, Mich.

[73] Assignee: Pepsico, Inc., Purchase, N.Y.

[21] Appl. No.: 933,441

[22] Filed: Aug. 14, 1978

Related U.S. Application Data

[63] Continuation-in-part of Ser. No. 735,900, Oct. 26, 1976, which is a continuation-in-part of Ser. No. 659,939, Feb. 20, 1976, Pat. No. 3,989,248, which is a continuation-in-part of Ser. No. 536,431, Dec. 26, 1974, abandoned.

[51] Int. Cl.[3] ..... C21D 6/02

[52] U.S. Cl. ..... 148/3; 148/142; 273/78

[58] Field of Search ..... 273/77 R, 77 A, 78, 273/164, 167–175; 148/3; 29/451

[56] References Cited

U.S. PATENT DOCUMENTS

| | | | |
|---|---|---|---|
| 1,359,220 | 11/1920 | Beamer | 273/78 |
| 2,447,967 | 8/1948 | Stone | 273/78 |
| 2,846,228 | 8/1958 | Reach | 273/167 F X |
| 3,061,310 | 10/1962 | Giza | 273/78 |
| 3,970,236 | 7/1976 | Rogers | 273/169 X |

FOREIGN PATENT DOCUMENTS

| | | | |
|---|---|---|---|
| 3822 | of 1893 | United Kingdom | 273/78 |
| 136792 | 12/1919 | United Kingdom | 273/78 |
| 379032 | 8/1932 | United Kingdom | 273/78 |

*Primary Examiner*—Charles E. Phillips

[57] ABSTRACT

A golf club of the iron type has a metal head with a front striking face and a slot spaced rearwardly from the striking face to provide a flexible and resilient striking plate. The thickness of the plate is such that the plate will: (a) resiliently flex and store energy when the striking face impacts a golf ball; (b) return to its original position to transfer energy to the ball as the ball leaves the striking surface; and (c) not deflect to such an extent that golf balls hit off center on the plate will be dispersed excessively from the intended line of flight

4 Claims, 13 Drawing Figures

METHOD OF MAKING IRON GOLF CLUBS WITH FLEXIBLE IMPACT SURFACE

RELATED APPLICATIONS

This application is a continuation-in-part of my copending application Ser. No. 735,900, filed Oct. 26, 1976, which was a continuation-in-part of my prior application Ser. No. 659,939, filed Feb. 20, 1976, now U.S. Pat. No. 3,989,248, which was a continuation-in-part of Ser. No. 536,431, filed Dec. 26, 1974, and now abandoned.

BACKGROUND

This invention relates to an iron golf club, and, more particularly, to an iron in which the club head is provided with a slot behind the striking face of the club head to provide a flexible and resilient plate for striking the ball.

When a golf iron is swung and the head of the iron impacts a golf ball, the club head absorbs energy. If the energy which is absorbed by the club during impact is not transferred to the ball before the ball leaves the club, this energy is lost with respect to the objective of propelling the golf ball. The duration of the impact between the ball and the club head, i.e., the time that the ball stays in contact with the club head, is extremely short, usually of the order of ½ millisecond, and all golf irons lose some energy which is not transferred to the ball within this time. This lost energy can take the form of shock waves, for example, which remain in the club after the ball leaves the face of the club.

If the amount of energy which is stored in the club when the ball leaves the club can be reduced, more energy will be transferred to the ball, the ball will leave the club with greater velocity, and the ball will be propelled farther. Attempts have been made to provide golf clubs with resilient faces for increasing the energy which is transferred to the ball. For example, British Pat. No. 379,032 describes a golf club in which a resilient metal plate is mounted on the club head with a cavity behind the plate. U.S. Pat. No. 1,854,548 describes making the striking face of a golf club more resilient by removing metal from behind the striking surface. U.S. Pat. No. 3,061,310 describes a club with a resilient ball-engaging wall which is spaced from the main body of the club head by a slot, but this club is a putter and is not intended to withstand the impact forces which are encountered by a striking iron. In recent years investment cast irons have become popular in which the thickness of the head is greater around the periphery of the striking face than in the center of the face.

While improvements in golf club head design have resulted in some increase in distance, energy still remains in the club after impact and is therefore lost. This can be best appreciated by considering the forces involved when a golf club strikes a golf ball. A golfer who would be considered a long hitter might develop a club head speed of about 137 feet per second with a 5 iron. The force exerted by the ball on the face of the club at that speed will be of the order of 1300 pounds. The magnitude of the impact force and the extremely short duration of impact necessarily means that some energy will remain in the club when the ball leaves.

SUMMARY OF THE INVENTION

The invention reduces the amount of energy which remains in the club when the ball leaves the club by transferring more energy to the ball. The ball therefore leaves the club with greater velocity, and will travel farther and higher. Golf irons made in accordance with the invention have a flexible and resilient striking plate which is deflected and stores energy when the club head strikes the ball and which rebounds to transfer the stored energy to the ball. The material of the plate and its thickness are such that the plate is strong enough to withstand the impact force of the ball while still deflecting sufficiently to store a significant amount of energy, and the frequency of vibration of the plate permits the plate to work in phase with the ball. The thickness of the plate decreases as the number of the iron, and therefore its loft, increases so that the deflection for each club will be approximately the same.

DESCRIPTION OF THE DRAWING

The invention will be explained in conjunction with illustrative embodiments shown in the accompanying drawing, in which.

DESCRIPTION OF THE SPECIFIC EMBODIMENTS

Figure 1:
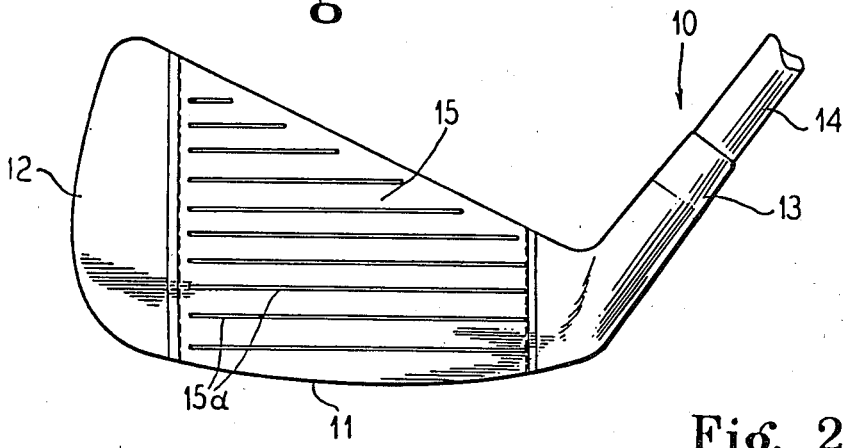
FIG. 1 is a front elevational view of one embodiment of a golf club head formed in accordance with the invention.

Tests have shown that a surface capable of flexing elastically during impact with a golf ball can produce higher ball velocities than a relatively rigid surface. With conventional clubs employing rigid club heads, the energy of impact is dissipated in random directions. In the new club head, the impact energy is stored as strain energy throughout the deflected face plate area. The stored energy is then returned to the ball as the ball leaves the face plate, which occurs about ½ millisecond after impact. The load is concentrated at the impact area and reacted at the supports, and the face plate acts as a deflectable beam. Consequently, more of the energy of impact is stored in a way that it can be returned to the ball than in conventional club heads.

With the club head of the present invention, the flexing of the face plate not only increases the amount of energy which is returned to the ball but also increases the duration of impact. This means not only a higher velocity for the ball but a higher trajectory. The higher trajectory is the result of the increased velocity of the spinning ball and the higher launch angle caused by the ball staying on the club face longer. As the club swings down and then up, the effective loft of the club and therefore the launch angle increases.

I have found that merely recognizing that a flexible and resilient striking surface will transfer more energy to a ball than a rigid striking surface is not enough to provide a satisfactory golf club. For example, the golf club described in British Pat. No. 379,032 is said to have a resilient striking face. However, to my knowledge this design was never commercialized, or if it was commercialized, the design has been abandoned. Many other factors in addition to the flexibility of the striking plate have an effect on the velocity which is imparted to the ball and the direction in which the ball is hit, and all of these factors should be optimized in order to achieve maximum performance.

The dimensions of the striking plate must be such that the striking plate will deflect significantly in order to store a substantial amount of energy. However, the material of the plate must be strong enough to support the impact force so that the plate does not fail. The frequency of vibration of the plate must also be considered. If the frequency of vibration is too high, the plate is too stiff and does not deflect enough to store the desired amount of energy. If the frequency of vibration is too low, two problems can arise: balls hit offcenter on the plate may be directed away from the intended line of flight; and the plate might continue to vibrate after the ball leaves. The energy which remains in the plate in the form of vibration is not transferred to the ball and is therefore lost.

I have found that for a conventional profile club a plate made of metal having a tensile strength of 150,000 psi and a thickness such that a direct center hit of a golf ball will cause a deflection of about 1/64 inch produces excellent results. Such a plate is thick enough to support the impact load of the ball and has a frequency of vibration which is high enough to prevent significant loss of accuracy on offcenter hits. Since the impact load on a club varies with the number of the club, i.e., the impact load on a 2 iron is greater than the impact load on a 9 iron, the thickness of the plate of each iron should be different in order to provide the desired amount of deflection.

The preferred embodiment of the invention, illustrated in FIGS. 7–13, is an investment cast iron. The material which is commonly used for investment cast irons is 17-4 stainless steel. However, this material has a tensile strength of only about 100,000 psi. If conventional 17-4 stainless steel is used to make the striking plate, the thickness of the plate which would be required to support the impact load would make the plate too stiff. In other words, the plate would not deflect enough to store a significant amount of energy for transfer to the ball. If the plate were made thin enough to deflect significantly, it would be too weak to support the impact load. Although materials are available which have a tensile strength of 150,000 psi, these materials are not satisfactory for casting golf club heads because they do not have satisfactory corrosion resistance or are too expensive.

I have solved this problem by first casting the club head from 17-4 stainless steel and then increasing the tensile strength of the metal to 150,000 psi by solution annealing and age hardening. This technique is well-known in the aerospace industry and need not be described in detail here, but to my knowledge the procedure has not heretofore been used for making golf clubs.

Figure 2:
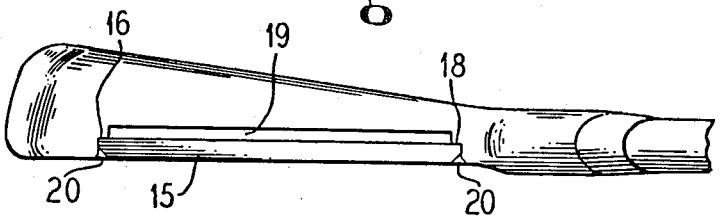
FIG. 2 is a top plan view of the club head of FIG. 1 showing the slot behind the striking face.
Figure 3:
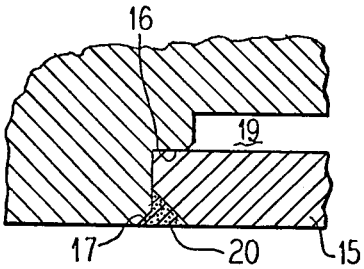
FIG. 3 is an enlarged fragmentary sectional view showing the manner in which the striking plate of the club of FIGS. 1 and 2 is secured.

Turning now to the specific embodiments shown in the drawings, in FIG. 1 there is illustrated a conventional profile iron-type club 10 having a sole portion 11, a toe portion 12, and a hosel 13 rigidly securing the club head to a shaft 14. In the form of the invention illustrated in FIGS. 1–3, there is provided a face plate 15 having grooves **15*a* formed therein. The interior of the body of the club head is milled away to provide a stepped configuration including a shoulder 16 (FIG. 3) and a chamfered portion 17. The grooved face plate 15 is seated against the shoulder 16 (and a similar shoulder 18 at the opposite side of the club head) to provide a slot 19 into which the face plate 15 can flex. The face plate 15 is secured to the body of the club head by means of weld deposits 20. The face plate 15, the weld deposits 20 and the remainder of the club head provide a flush striking surface for the ball as shown in FIG. 3**.

The improvements of the present invention are, of course, applicable to any type of iron club. In loft, for example, they may extend from about 18° in a No. 1 iron, up to 50° or so in the case of a pitching wedge. In FIG. 1, the dimensions A and B refer to the slot height at the toe of the club and at the heel of the club, respectively. Typical values, in inches, for the dimensions A and B are given below:

| Club Head No. | A.in. | B.in. |
|---|---|---|
| 1 | 1.720 | 0.875 |
| 2 | 1.781 | 0.906 |
| 3 | 1.875 | 0.938 |
| 4 | 1.938 | 1.000 |
| 5 | 2.000 | 1.031 |
| 6 | 2.094 | 1.094 |
| 7 | 2.188 | 1.188 |
| 8 | 2.250 | 1.250 |
| 9 | 2.250 | 1.313 |
| PW | 2.344 | 1.313 |

In the club heads mentioned above, the width of the face plate was 2.375 inches, and the slot had a depth of 0.063 inch.

The thickness of the striking face, i.e., the metal ahead of the slot, is in the range from about 0.1 inch for the pithcing wedge to about 0.125 inch for the No. 1 iron. This metal thickness can be reduced, if desired, for ladies' clubs so that for a lower applied force, the same stress levels will exist in the face plate as for men's clubs.

The objective in varying the face thickness with the loft and length of the club is to produce faces in each club in the set which work to the same nominal stress level, even though the impact force varies with each club.

The face plate must be thick enough to support the impact load. Consequently, I prefer to use tough material such as 17-4 stainless steel heat treated to a minimum hardness of 40 on the Rockwell "C" scale. To achieve this type of hardness, the stainless steel may be solution annealed and age-hardened in accordance with conventional stainless steel metallurgy.

The minimum yield strength should be at least 150,000 psi (1034 MPa). This value too, can be achieved by conventional heat treatment techniques for stainless steels.

Figure 4:
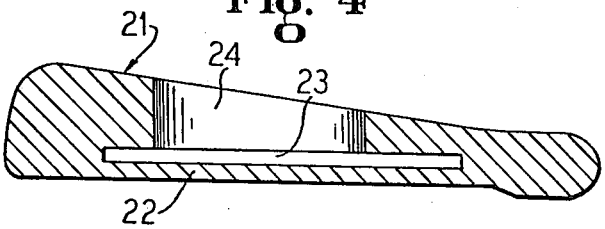
FIG. 4 is a cross sectional view of another embodiment of a club head made in accordance with the invention.

FIG. 4 of the drawings illustrates another form of the invention utilizing a club head 21 which includes an integral striking plate 22, the plate being separated from the remainder of the body of the club head by means of a slot 23. An elongated hole 24 is provided in the back of the club head and communicates with the slot 23. The type of club shown in FIG. 4 can be readily made by conventional investment casting procedures wherein a wax or plastic pattern of the club head is made. Repeated dips of the pattern into refractory containing suspensions, followed by drying, produces a shell about the pattern. After casting of the metal into the casting cavity, the shell may be removed by conventional investment casting techniques. The hole 24 permits the investment material to easily fill the slot in the wax pattern.

In the case of either the investment cast club head or the club head in which a face plate is welded on, the slot preferably has a depth in the range from about 0.04 to about 0.10 inch (0.1 to 0.25 centimeters).

Figure 5:
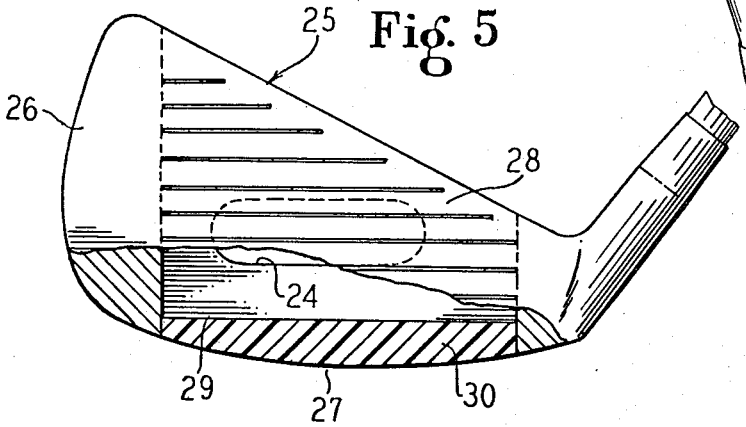
FIG. 5 is a front elevational view, partially broken away, of a modification of the club of FIG. 4 which includes a resilient filler material in the bottom portion of the slot.
Figure 6:
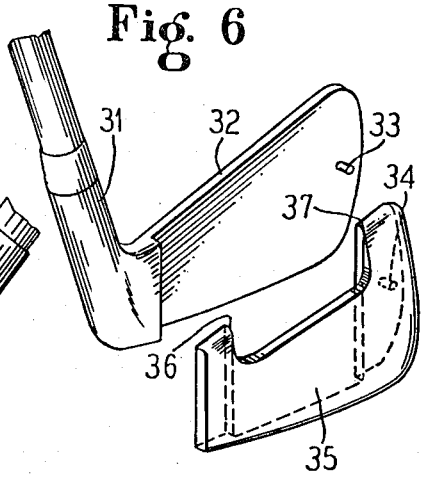
FIG. 6 is an exploded perspective view of still another embodiment of the invention.
Figure 7:
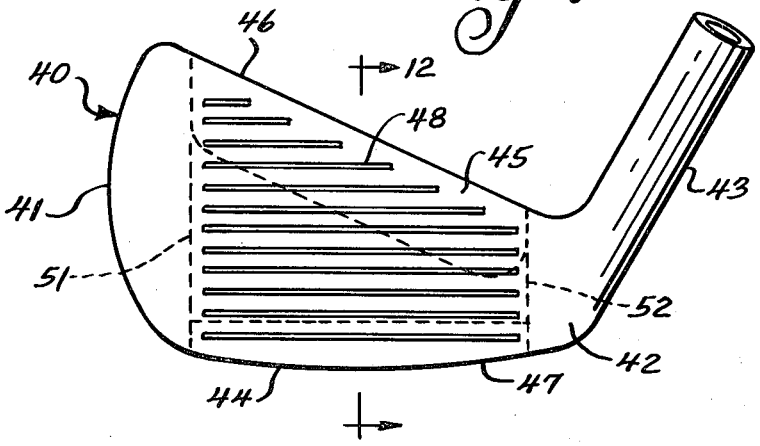
FIG. 7 is a front elevational view of the preferred embodiment of the invention.
Figure 8:
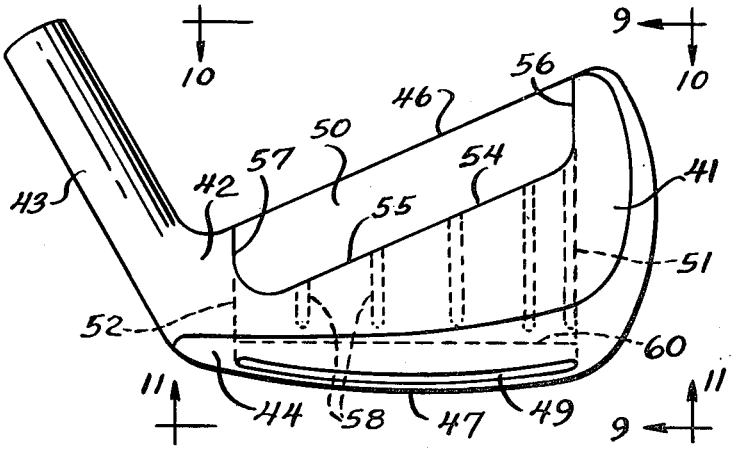
FIG. 8 is a rear elevational view of the club head of FIG. 7.

A modified form of the invention is also shown in FIG. 5 of the drawings. This drawing shows an integral iron club head 25 as shown in FIG. 4 and having a toe portion 26 and a sole portion 27. An integral face plate portion 28 provides a slot 29 between the back of the face plate portion 28 and the body of the club head. A resilient strip 30 composed of rubber or the like is inserted in the bottom of the slot 29 in the sole portion to prevent grass or dirt from finding its way into the interior of the club. The strip 30 may extend from the sole portion up to about the first groove in the face plate. The strip 30 may be composed of a soft resilient material such as foam rubber or foamed resins which are insufficiently rigid to affect the rebound characteristics of the face plate portion. The addition of the strip also tends to deaden any ringing sound which can be produced when a ball is hit off center with this type of iron.

In the form of the invention shown in FIG. 5, I provide an integrally cast hosel 31 and a face plate portion 32. At the back of the face plate portion 32 there is a locating pin 33 which is snugly received within a blind ended bore 34 provided in a separate back piece 35. The back piece 35 has shoulders 36 and 37 which abut against the back of the face plate portion 32 to define a slot therebetween, the back piece 35 being secured to the face plate portion 32 by brazing or welding.

The preferred embodiment of the invention is shown in FIGS. 7–12. The club head 40 is integrally cast by the conventional investment casting technique and includes a toe portion 41, heel portion 42 from which a hosel 43 extends, and a sole portion 44. The front or striking face 45 of the club has upper and lower edges 46 and 47 and is provided with grooves 48.

A slot 49 (FIGS. 10–12) extends through the body of the club head from the upper edge 46 to the lower edge 47 behind the striking face to form a striking plate 50. The end edges 51 and 52 of the slot extend perpendicularly to the grooves 48 in the club face (see FIG. 7) and are spaced slightly outwardly from the ends of the grooves. The striking plate is supported only at the end edges 51 and 52 and is essentially a trapezoidally shaped beam supported at its parallel ends.

The rear surface 53 of the club is recessed at 54 (FIG. 8) behind the slot so that more of the weight of the club can be positioned below the center of gravity of the club and around the perimeter of the club. The upper edge 55 of the recess extends parallel to the upper edge 46 of the striking face, and the end edges 56 and 57 of the recess are aligned with the end edges of the slot. A plurality of grooves 58 extend downwardly from the upper edge 55 of the recess parallel to the end edges of the slot. The purpose of the grooves 58 is to provide reinforcing ribs on the portion of the ceramic shell formed during the investment casting procedure which occupies the slot 49.

A filler plug 60 closes the bottom of the slot to keep the slot free of dirt and to prevent ringing caused by high frequency vibration of the striking plate on offcenter hits. Polyurethane having a maximum Shore durometer of 85 has proved to be particularly advantageous. The deformability and the height of the filler plug are such that the plug does not interfere with the flexibility of the striking plate. The height of the plug is about 3/16 inch at the center of the slot and about 1/16 inch at the ends of the slot.

The club head 40 is cast from 17-4 stainless steel, and after casting the club head is solution-annealed and age-hardened to increase its tensile strength to at least 150,000 psi. The solution-annealing and age-hardening process is performed in accordance with Aerospace Material Specification AMS 5355B published by the Socieity of Automotive Engineers, Inc. Briefly, the club head is heated either under vacuum or in a controlled gas atmosphere to a temperature of 1900°±25° F. The club head is held at this temperature in accordance with the specification and then cooled at a controlled rate. Thereafter, the loft and lie of the head is adjusted by bending the body of the club head relative to the hosel. The club head is then precipitation age-hardened at 925°±25° F. for at least 90 minutes and then air cooled.

As described previously, the thickness of the striking plate is selected so that the plate of each iron will deflect about 1/64 inch under the impact force that is likely to be exerted on the striking plate when the ball is struck during normal play. The impact force is a function of club head speed, club head weight, and ball weight, and the component of the impact force which deflects the striking plate decreases as the number of the iron increases because of the increasing loft and the decreasing club head speed. The average impact force P can be calculated by the formula:

$$P = \frac{W_b(1 + e)V_cW_c}{gt(W_c + W_b)}$$

where $W_b$=weight of ball $W_c$=weight of club head $V_c$=velocity of club head e=coefficient of restitution (This is a measure of the rebound efficiency of the ball off the face of the club and is a joint property of the ball and club. Its value is about 0.8.)

g=acceleration of gravity t=impact duration

The velocity of the club head is a function of the length of the club, which decreases as the number of the iron increases, and the angular velocity of the club generated by the player. The club should be designed to withstand the impact force created by swinging the club head at the greatest speed which is likely to be caused by the longest hitters.

Figure 9:
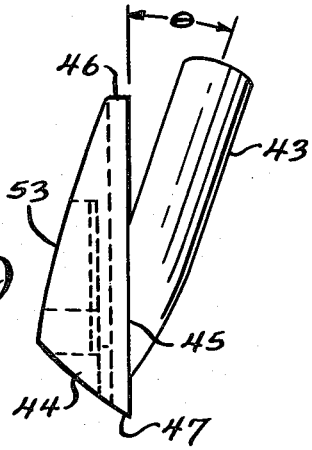
FIG. 9 is an end elevational view taken along the line 9—9 of FIG. 8.
Figure 10:
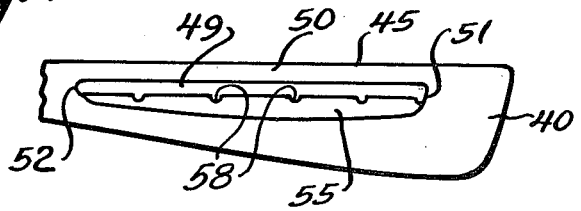
FIG. 10 is a fragmentary top plan view taken along the line 10—10 of FIG. 8.
Figure 11:
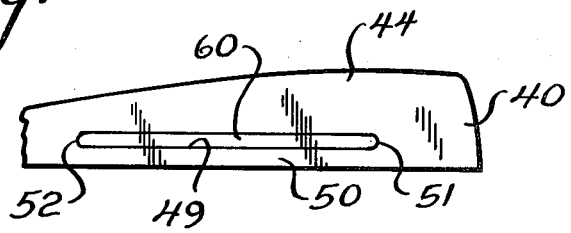
FIG. 11 is a fragmentary bottom plan view taken along the line 11—11 of FIG. 8.
Figure 12:
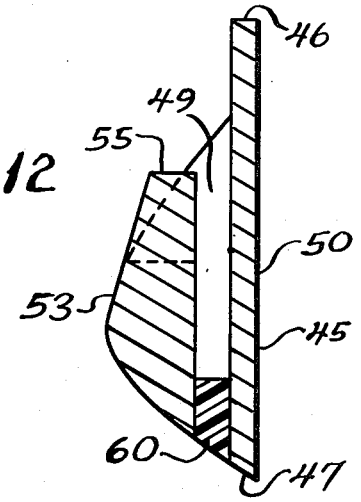
FIG. 12 is an enlarged sectional view taken along the line 12—12 of FIG. 7.

The force F which deflects the striking plate is the component of the impact force which is exerted in a direction normal to the plate:

$$F = P \cos \theta$$

where $\theta$ is the angle of loft of the club (see FIG. 9).

The deflection of the striking plate is a function of the thickness and shape of the plate as well as the impact force and other factors. The deflection can be calculated from standard formulas for a beam having both ends fixed with a partial uniform load applied, e.g., Roark, "Formulas For Stress And Strain," McGraw-Hill Book Co. (1965) p. 112.

The maximum bending moment in the plate occurs at the edges of the slot, and the thickness of the striking plate must be at least sufficient to withstand this stress. The minimum thickness t is:

$$t = \sqrt{\frac{6M}{ef_b}}$$

where

M = bending moment at the edge e = effective beam width $f_b$ = maximum stress that the material can withstand, which is the tensile strength of the material M can be calculated using formulas from Roark, p. 112.

Following the foregoing principles, a complete set of irons made in accordance with the preferred embodiment shown in FIGS. 7–12 has the following dimensions:

| No. of Iron | Loft | A(Inches) | B(Inches) | Thickness of Striking Plate (Inches) |
|---|---|---|---|---|
| 2 | 20° | 1.800 | 0.938 | 0.133 |
| 3 | 23° | 1.862 | 0.969 | 0.130 |
| 4 | 26° | 1.942 | 1.000 | 0.128 |
| 5 | 30° | 1.986 | 1.031 | 0.125 |
| 6 | 34° | 2.048 | 1.062 | 0.122 |
| 7 | 38° | 2.110 | 1.093 | 0.118 |
| 8 | 42° | 2.218 | 1.180 | 0.114 |
| 9 | 46° | 2.250 | 1.211 | 0.109 |
| PW | 50° | 2.281 | 1.242 | 0.105 |

where Loft is the angle $\theta$ in FIG. 9, A is the height of the striking plate at the edge 51 of the slot, and B is the height of the striking plate at the edge 52 of the slot. The length of the striking plate, i.e., the dimension between the end edges 51 and 52 of the slot, is 2.312 inches for each club. The depth of the slot is 0.090 inch for each club.

Each plate is thick enough to withstand the maximum stresses that are likely to be encountered during normal play yet thin enough to permit a deflection of about 1/64 inch when the club is swung by a strong hitter. Further, the frequency of vibration of each plate is within a range of about 2500 cycles per second to about 4000 cycles per second. If the frequency of vibration of the plate is below about 2500 cps, there is a tendency for balls to be dispersed on either side of the intended line of flight when the balls are hit away from the center of the plate. If the frequency of vibration of the plate is below about 600 cps, there is a possibility that the plate will vibrate after the ball leaves the striking face, and the energy of vibration will be lost. As the frequency of vibration begins to exceed about 4000 cps, the plate becomes too stiff and will not deflect sufficiently. Accordingly, the frequency of vibration of the plate should be within the range of about 2500 to about 4000 cps. Within this range the elastically deformable ball and the elastically deformable plate work in phase with each other, and the ball will dampen the rebound of the plate so that the plate will not vibrate after the ball leaves the striking surface.

The amount of deflection of the striking plate and therefore the amount of stored energy that can be transferred to the ball depends upon how fact the club is moving when it hits the ball. Long hitters who generate substantial club head speed, e.g., 137 feet per second for a 5 iron, will therefore cause the plate to deflect more than short hitters. However, I have found that the invention provides an advantage even for short hitters who do not generate as much club head speed. The striking plate will still be deflected and will increase the velocity of the ball, and the short hitter will get about the same percentage increase in distance as a long hitter. If desired, the clubs could be sold in sets which are specifically designed for long hitters, short hitters, etc. The thickness of the striking plates of the clubs intended for short hitters would be thinner so that the plates would be deflected about 1/64 inch when swung by the average short hitter.

Figure 13:
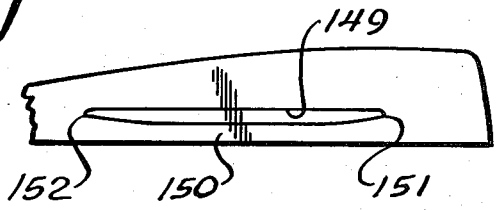
FIG. 13 is a bottom plan view similar to FIG. 11 of a modified embodiment of the club head of FIGS. 7–12.

FIG. 13 illustrates a modified embodiment in which the thickness of the striking plate 150 is greater at the edges 151 and 152 of the slot 149 than at the middle. The maximum bending moment in the striking plate occurs at the edges of the slot, and the bending moement at the center of the plate is less (see Roark, p. 112). The thickness of the plate can therefore be reduced at the center to permit greater deflection, and there will still be enough material to withstand the impact force of a center hit. The thicker end portions of the plate also reduce the possibility that offcenter hits will be dispersed from the intended line of flight. I have found that clubs made in accordance with the invention not only provide greater distance than conventional clubs but do so without loss of accuracy. In fact, the invention permits the accuracy of the club to be increased.

As used herein, the term "accuracy" refers to the amount that balls are dispersed from the intended line of flight when the balls are hit offcenter either toward the heel or toward the toe of the club. With a conventional club, balls hit on the toe are dispersed to the right of the intended line of flight, and balls hit on the heel are dispersed to the left. The amount of dispersion over a statistically significant number of hits is a function of the moment of inertia of the club head about its center of gravity. The higher the moment of inertia (or radius of gyration), the less the club head tends to rotate during impact and the straighter the ball flies.

When a ball is hit by the striking plate of a club formed in accordance with the invention at a point spaced away from the center toward the toe of the club, the striking plate will be deflected in a curved configuration, with the maximum amount of deflection occurring at about the center of the striking plate, i.e., approximately midway between the edge supports for the plate. It is believed that the curve in the plate causes the ball to roll toward the center of the plate, thereby imparting a hook spin to the ball which causes the ball to curve from right to left toward the intended line of flight. By adjusting the thickness of the plate and therefore its deflection, the amount of hook spin on toe hits can be controlled so that the ball will land substantially on the intended line of flight.

Similarly, a ball hit by the striking plate toward the heel of the plate will have a tendency to roll toward the center of the plate and will pick up a slice spin. The slicing action can be controlled by adjusting the thickness of the plate so that the ball curves from left to right and lands substantially on the intended line of flight.

If the striking plate is too thin, excessive hook spin will be imparted to the ball on a toe hit, and the ball will actually curve across the intended line of flight. Similarly, excessive slice spin will be imparted to a ball hit on the heel, and the ball will curve from left to right across the intended line of flight.

If the striking plate is made too thick, not enough corrective spin will be applied to the ball to bring the ball back to the intended line of flight. A toe hit will remain on the right side of the intended line of flight, and a heel hit will remain on the left side of the intended line of flight.

I have found that the thicknesses of the striking plates for the complete set of irons previously described with respect to FIGS. 7–12 provide good dispersion characteristics.

While in the foregoing specification a detailed description of specific embodiments was set forth for the purpose of illustration, it will be understood that many of the details hereingiven may be varied considerably by those skilled in the art without departing from the spirit and scope of the invention.

I claim:

1. In a method of investment casting a head of a golf club iron, the steps of:

(a) casting the club head with corrosion resistant stainless steel to provide a club head having upper and lower edges, a heel portion, a toe portion, a front striking face extending between the upper and lower edges, and a slot behind the front striking face extending from the upper edge to the lower edge to provide a flexible and resilient striking plate which is separated from the remainder of the body at the upper and lower edges thereof but which is joined to the remainder of the body in the heel and toe portions;

(b) making the thickness of the striking plate such that when the material of the plate has a tensile strength of about 150,000 psi:

(i) the center of the plate is elastically deflected about 1/64 inch by the impact force exerted on the center of the plate by a golf ball when the club head is swung at the maximum speed that can be expected during normal play;

(ii) the maximum stress within the plate when the plate strikes a golf ball at the maximum speed that can be expected during normal play is less than the tensile strength of the material of the plate; and (iii) the frequency of vibration of the plate is between about 2500 cycles per second and about 4000 cycles per second;

(c) annealing and hardening the club head after it is cast to increase its tensile strength to at least about 150,000 psi.

2. The method of claim 1 including the step of filling the bottom of the slot with flexible and resilient material to prevent dirt from entering the bottom of the slot.

3. The method of claim 1 including the step of filling the bottom portion of the slot with flexible and resilient material to prevent dirt from entering the bottom of the slot and leaving the upper portion of the slot above the flexible and resilient material unfilled.

4. The method of claim 1 in which the corrosion resistant stainless steel which is used to cast the club is 17-4 stainless steel having a tensile strength of about 100,000 psi before the annealing and hardening step.

* * * * *